United States Patent [19]

Goldsworthy

[11] 4,011,604

[45] Mar. 15, 1977

[54] APPARATUS EMPLOYING A THREE PORT CHAMBER AND TWO SELECTIVELY OPERABLE VALVES FOR CONTROLLING THE QUANTITY OF WATER FLUSHED BY A TOILET

[76] Inventor: Forrest C. Goldsworthy, 2595 Aragon Court, San Jose, Calif. 95125

[22] Filed: Apr. 26, 1976

[21] Appl. No.: 680,047

[52] U.S. Cl. ..... 4/34; 4/57 P; 4/67 R; 4/67 A

[51] Int. Cl.[2] ..... E03D 1/34; E03D 5/02; A61B 19/00

[58] Field of Search ..... 4/35, 37, 67 R, 67 A, 4/57 P, 34

[56] References Cited

UNITED STATES PATENTS

| | | | |
|---|---|---|---|
| 2,532,977 | 12/1950 | White | 4/67 A |
| 2,864,095 | 12/1958 | Martino | 4/67 A X |
| 3,237,211 | 3/1966 | Brown | 4/34 |
| 3,375,531 | 4/1968 | Lake | 4/57 P |
| 3,768,103 | 10/1973 | Robinson | 4/67 A |
| 3,795,016 | 3/1974 | Eastman | 4/67 A |
| 3,894,299 | 7/1975 | Cleary | 4/67 A |

*Primary Examiner*—Henry K. Artis
*Attorney, Agent, or Firm*—Boone, Schatzel, Hamrick & Knudsen

[57] ABSTRACT

An improved apparatus for controlling the quantity of water flowing through a water outlet in a toilet tank comprising a rotatable shaft having opposed first and second ends disposed through an opening in the front wall of the toilet tank, a crank mounted to the tank, connected to the first end and being capable of rotating the shaft through first and second angles when a force is applied to it, an arm connected to the second end, a box-like structure forming a chamber disposed in the tank and including first and second upwardly extending tubes forming first and second ports, respectively, an upwardly extending overflow tube, and a third port arranged to discharge water through the water outlet, the first tube having an axial dimension that is greater than the second tube, a first flapper valve hingedly connected to the overflow tube and being normally seated on the first port, the first valve being movable from a normally closed position to an open position, a second valve hingedly connected to the overflow tube and being normally seated on the second port, the second valve being movable from a normally closed position to an open position.

11 Claims, 2 Drawing Figures

APPARATUS EMPLOYING A THREE PORT CHAMBER AND TWO SELECTIVELY OPERABLE VALVES FOR CONTROLLING THE QUANTITY OF WATER FLUSHED BY A TOILET

BACKGROUND OF THE INVENTION

1. Field of the Invention

The present invention relates generally to apparatus for controlling the outflow of the flushing water into a toilet bowl, and more particularly, to such an apparatus that employs a three-port chamber, two valves and a crank for selectively controlling the quantity of water flushed.

2. Description of the Prior Art

Conventional toilet tanks generally contain between five and six gallons of water and utilize subsantially all of such water during a flushing operation. It has been recognized that the use of such large quantities of water in all instances is not necessary since the flushing away of waste liquids requires only a fraction of the water required for flushing solid matter. For example, it has been determined that approximately seven quarts of water is sufficient to remove liquid waste whereas about 3½ gallons of water is sufficient to remove solid waste. In view of such waste and because of the interest of society in preserving our natural resources water conservation legislation is presently being enacted in several of the states.

In the patent art, mechanisms for providing a partial flush or a full flush are disclosed in U.S. Pat. No. 3,237,211, "Self-Attaching Dual Flush Valve Assembly" by M. F. Brown and in U.S. Pat No. 3,768,103, "Toilet Tank Flush Valve Assembly" by Burton H. Robinson. These patents do not reveal an apparatus that utilizes a three-port chamber, two valves, and a rod pivotally connected between the distal end of the arm and the valves with chains having preselected lengths for selectively controlling the quantity of water flushed.

SUMMARY OF THE INVENTION

It is therefore a primary object of the present invention to provide an improved apparatus for controlling the quantity of water flowing through the outlet in a toilet tank.

Another object of the present invention is to accomplish the previously stated object by employing a three-port chamber and a mechanism employing an arm and a rod pivotally connected to the arm which serves to selectively open one or two valves associated with the two inlet ports of the chamber to control the level, and hence the quantity of, the flushing water flowing through the outlet port.

Yet another object of the present invention is to provide such an apparatus having a dial-like crank which is rotatable through one of two preselected angles which correspond to a partial or full flush of the toilet.

Briefly, the preferred embodiment includes a rotatable shaft having opposed first and second ends disposed through an opening in the front wall of a toilet tank, a crank mounted to the tank, connected to the first end and being capable of rotating the shaft through first and second angles when a force is applied to it, an arm connected to the second end, a box-like structure forming a chamber disposed in the tank and including first and second upwardly extending tubes forming first and second ports, respectively, an upwardly extending overflow tube, and a third port arranged to discharge water through the water outlet, the first tube having an axial dimension that is greater than the second tube, a first flapper valve hingedly connected to the overflow tube and being normally seated on the first port, the first valve being movable from a normally closed position to an open position, a second valve hingedly connected to the overflow tube and being normally seated on the second port, the second valve being movable from a normally closed position to an open position, a pivot rod having first and second outer portions and an intermediate portion that is pivotally connected to the distal end of the arm, a first chain connected between the first outer portion and the first valve and having a first length generally equal to the distance between those elements when the first valve is in the closed position, a second chain connected between the second outer portion and the second valve and having a second length generally equal to the distance between those elements when the first valve is in the open position, whereby when a force rotates the crank toward the first angle, the arm is raised causing the rod to pivot toward the first valve, and the first chain to become taut and unseat the first valve such that when the crank reaches the first angle the first valve is moved into the open position causing water to flow through the first port and out of the third port, the first valve being closed by the suction action of the outflowing water when it reaches a level slightly above that corresponding to the first port, and whereby when the crank is rotated through an angle greater than said first angle, the second chain becomes taut, the rod pivots toward the second valve and thereafter unseats the second valve such that when the crank reaches the second angle the second valve is moved into the open position causing water to flow through the first and second ports and out of the third port, the first port being closed when the water level falls to about that corresponding to the first port and the second port being closed when the water reaches a level slightly above that corresponding to the second port.

Among the important advantages of the present invention is that it provides a means by which a relatively small amount of flushing water can be used when it is desired to flush away only fluids, and an increased amount of water can be used when it is desired to flush away some solid matter.

Another advantage of the present invention is that it includes a mechanism which serves to open one or two valves associated with a three-port chamber to control the level of flushing water in a toilet tank.

These and other objects and advantages of the present invention will no doubt become apparent following a reading of the detailed description of the preferred embodiment which are illustrated in the several figures of the drawing.

IN THE DRAWING

FIG. 1 is a perspective view of an apparatus for controlling the quantity of water flow in accordance with the present invention; and FIG. 2 is an exploded perspective view of the apparatus of FIG. 1.

DETAILED DESCRIPTION OF THE PREFERRED EMBODIMENTS

Figure 1:
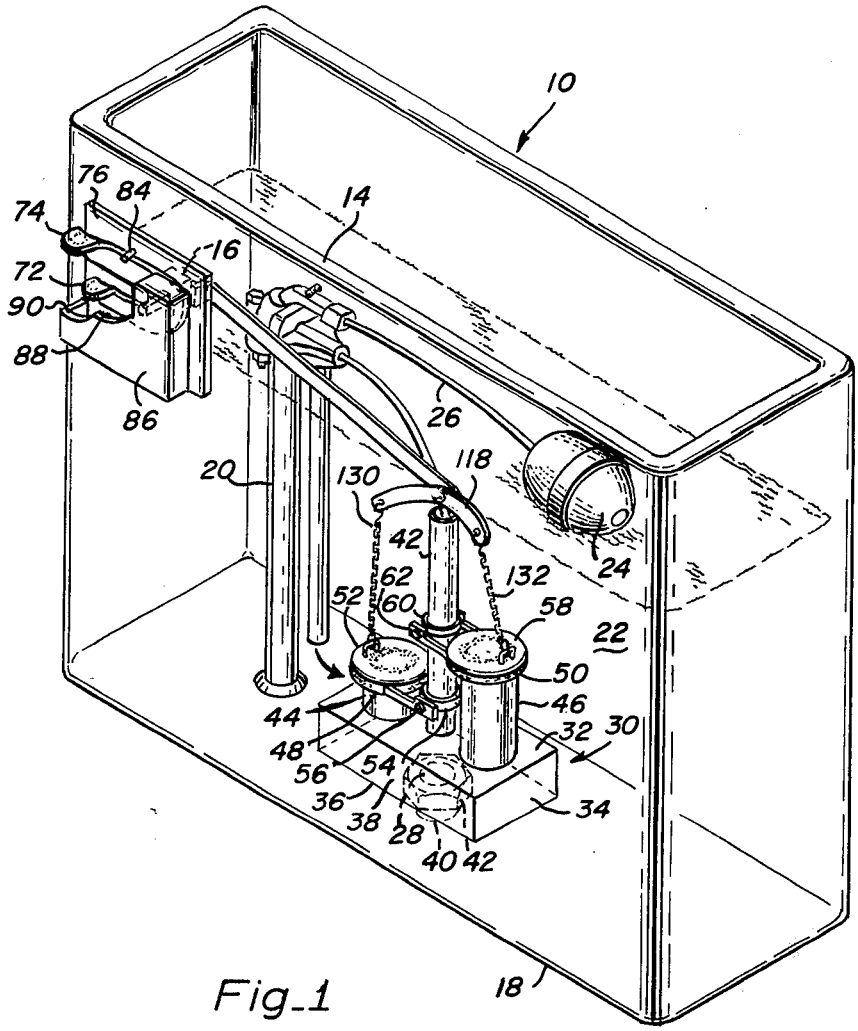

Referring now to FIG. 1 of the drawing, an apparatus 10 for controlling the quantity of water flowing through an outlet in the tank of a toilet in accordance with the present invention is illustrated in a perspective view.

As shown, the tank on which the apparatus 10 is installed is a water-holding tank having a front wall 14 with a square hole 16 through its upper lefthand corner and a bottom wall 18. A fill tube 20 extends through the bottom wall and serves as an inlet for water, generally illustrated by the numeral 22, flowing into the tank. A ball float 24 depending from a rod 26 affixed to the fill tube 20 serves to control the level of the water allowed to enter the tank in a manner which is well known to those skilled in the art. An outlet or hole 28 in the bottom wall 18 permits the flow of water out of the tank and into the toilet bowl (not shown).

In accordance with the present invention a box-like structure 30 including a top wall 32, side walls 24 and a bottom wall 36 so as to form an enclosed chamber 38 is disposed on the bottom wall 18 of the tank. A short tubularly-shaped port 40 depends from the bottom wall 36 through the outlet 28. The lower portion of the port 40 is threaded to receive a nut 42 in a conventional locking arrangement, thus securing the structure 30 to the tank. An O-ring or the like (not shown) is disposed around the port 40 and serves to seal the outlet 28. An overflow tube 42 and water inlet tubes 44 and 46 extend upwardly through the top wall 32. The overflow tube 42 is disposed centrally between the tubes 44 and 46 and provides a path through the chamber 38, port 40 and outlet 28 for the overflowing water to escape should it reach a level above that of the ball float 24. The inlet tube 44 includes a port 48 serving as a seat for a flapper valve or the like and has an axial length such that the port 48 is a predetermined distance below the water level corresponding to the upper end of the overflow tube 42. Similarly, the inlet tube 46 includes a port 50 serving as a seat for a flapper valve or the like and has an axial length much more than that of the tube 44.

A flapper flush valve 52 includes an annulus 54 and a hinge 56. The annulus 54 serves to frictionally contact the outer surface of the overflow tube 42 so as to hingedly mount the flapper valve thereto. Such valve is movable between a normally closed position wherein it is seated on the port 48 and an open position wherein it is unseated from the port 48. The valve 52 serves to prevent the flow of water into the toilet bowl when it is seated on the port 48. A flapper flush valve 58 identical in construction and operation to the valve 52 includes an annulus 60 and a hinge 62 and is also mounted to the overflow tube 42 and serves to prevent the flow of water into the toilet bowl when in the closed position and while allowing such flow when it is in the open position.

In the preferred embodiment the box-like structure and inlet and overflow tubes is integrally formed from plastic material, the port of the shortest inlet tube is about 2½ inches above the bottom wall of the tank, the diameter of the inlet tubes is about 2¼ inches, and the overflow tube is centrally disposed between the two inlet tubes. In addition, the flapper flush valves are of the type manufactured by the Plumbcraft Manufacturing Corporation and designated by them as the model Mr. Flapper.

Figure 2:
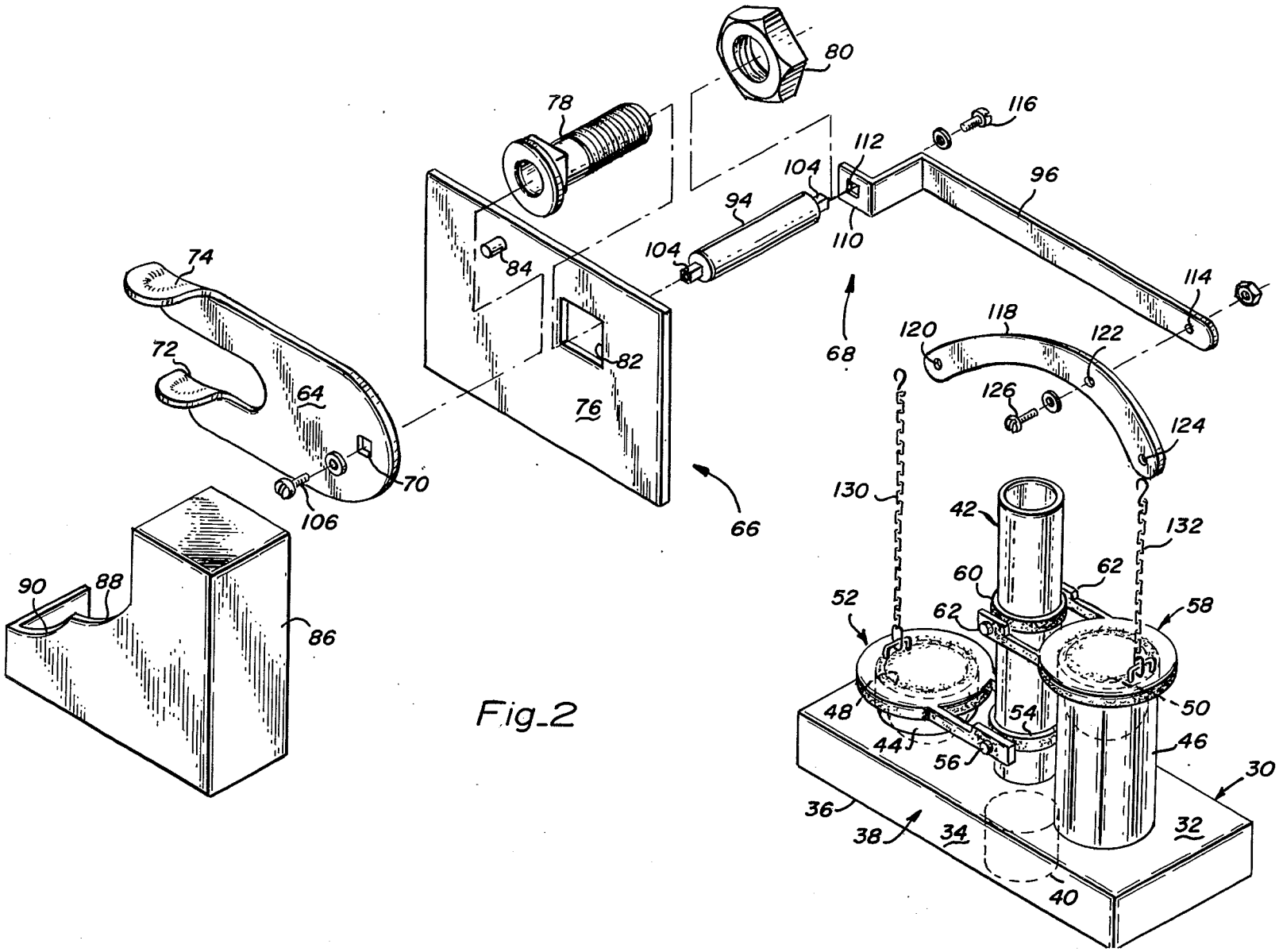

Referring also to FIG. 2, which illustrates the parts of the apparatus 10 in an exploded perspective view, the apparatus comprises a crank 64, a mounting assembly 66 for mounting the crank 64 to the front wall 14 of the tank and a mechanical linkage 68. The crank 64 is an elongated member having a square key hole 70, and a bifurcated end forming two separated fingers 72 and 74. The fingers 72 and 74 have generally planar upper surface that are shaped to conform to the fingers of the person operating the device.

The mounting assembly 66 comprises a generally rectangular mounting plate 76, a hollow mounting sleeve 78 and a nut 80. The mounting plate 76 is adapted to be secured to the front wall 14 and includes a square hole 82 in alignment with the hole 16 and an upper stop 84 for limiting the upward movement of the fingers 72 and 74. The sleeve 78 is a type of hollow shoulder screw having a square shoulder and a threaded shank. The square shoulder serves to mate with the inner periphery of the hole 82, while the shank extends through the hole 16. The nut 80 secures the mounting plate 76 to the tank 12.

A cover 86 is secured to the front face of the mounting plate 76 with a frictional fit, screws or other similar fastening devices. The cover 86 is a box-like enclosure having cut-away portions that form stop surfaces 88 and 90. The stop surface 88 is in arcuate alignment with the finger 72 and serves to limit the rotational movement of the finger 72, and hence the crank 64, during a half-flush operation as will be subsequently described. Similarly, the stop surface 90 is in arcuate alignment with the finger 74 and serves to limit the rotational movement of the finger 74, and hence the crank 64, during a full-flush operation.

In the preferred embodiment, the stops 84 and 88 limit the rotational movement to about 22.5° whereas the stops 84 and 90 limit the movement to about 45°.

The mechanical linkage 68 includes a rotatable drive shaft 94 and an arm 96. The drive shaft 94 has an axial length substantially the same as that of the sleeve 78 and a diameter slightly less than that of the sleeve after the mounting plate is secured to the tank. Square key pins 104 having threaded holes protrude from each end of the shaft 94. One of the pins 104 extends into the key hole 70 of the crank 64 and is secured thereto by a screw 106 and a washer. The arm 96 includes an end portion 110 having a key hole 112, a center portion bent at a right angle relative to the end 110 and an elongated end portion that is generally parallel to the end 110 and has a hole 114 therethrough. A screw 116 secures the end 110 to the pin 104.

A pivot rod 118 having an arcuate shape with holes 120, 122 and 124 is pivotally secured through the hole 122 to the arm 96 with a screw 126 and nut assembly. Because of its arcuate shape both of the holes 120 and 124 lie below the hole 122 when the rod is thus mounted. Hence when the rod is pivoted its ends do not strike the cover of the tank (not shown). In the preferred embodiment the distance between the holes 124 and 122 is about one and one-half times the distance between the holes 120 and 122.

A chain 130 is secured to the hole 120 and a loop in the top of the flapper valve 52. In a similar manner, a chain 132 extends between the hole 124 and the flapper valve 58. With the valve 52 in the closed position the chain 132 is relatively taut so that when a force is exerted to raise the chain 132 the flapper valve 58 is almost simultaneously actuated and unseated from the port 50. However, the chain 130 has a length such that it is normally slack, but becomes taut when the flapper valve 58 is in the open position. Thus, a force in excess of that required to open the valve 58 serves to raise the arm 96, pivot the rod 118 until the chain 130 is taut and raise and unseat the valve 52 so as to move it into an open position.

In the preferred embodiment, the chain 132 has a length of about 3½ inches and the chain 130 has a length of about 7½ inches.

As assembled, the mounting plate 76 abuts the front wall 14 of the tank with the holes 16 and 82 in substantial alignment. The mounting sleeve 78 is inserted through the hole 16 and 82 and secured in place by the nut 80. The rotatable shaft 94 extends through the hollow interior of the sleeve 78. The crank 64 is keyed to the rotatable pin 104 of the shaft 94, and the stop plate cover 86 is affixed to the mounting plate 76. The stops 88 and 90 thus defines reference surfaces which serves to receive the fingers 72 and 74 when the crank is rotated, and to limit the movement of the hand of the user when the finger 72 or 74 is disposed against the stop 88 or 90.

In operation, when a partial flush is desired, the user pushes down the finger 72 with his hand until the finger 72 is received by the stop 88 which in turn stops the downward movement and restrains the movement of the fingers of his hand. This causes the crank 64 and hence the shaft 94 to rotate through an angle of about 22.5°. The rotation of the shaft 94 drives the arm 96 in a counterclockwise direction so that the end 114 moves upwardly. As the end 114 rotates upwardly the chain 132 tends to become taut causing the pivot rod 118 to pivot in a clockwise direction and thereafter raise. This causes the chain 132 to force the valve 58 to pivot about the hinge 62 which unseats the valve from the port 50. As a result the water 22 flows through the port 50 and the chamber 38 and out of the port 40 and the outlet 28 into the toilet bowl, thereby causing a flushing of the toilet. As the water reaches a level just above the port 50 the suction associated with the flowing water draws the valve 58 closed, this terminates the water flow into the toilet.

In the preferred embodiment the 22.5° rotation of the crank allows the valve 58 to remain open for about 2½ seconds. It has been found that this time allows about 7 quarts of water to flush into the toilet, which amount is sufficient to cause a complete flushing of urine or other water waste from the toilet.

When a normal flush is desired, the user depresses the finger 74. In a manner similar to that just described when the finger 74 is received by the stop 90 downward movement of the crank is stopped. This causes the shaft 94 and the arm 96 to rotate in a counterclockwise direction so that the end 114 and the chain 132 move upwardly and the valve 58 pivots open. Thereafter the chain 132 becomes taut and the rod 118 pivots in a counterclockwise direction toward the valve 52 as it raises causing the valve 52 to become unseated rom the port 48. With the valve 52 open, water flows through the ports 48 and 50, the chamber 38 and out of the port 40. When the water level falls to a level just above the port 50, the valve 58 closes and when it falls to a level just above the port 48, the valve 52 closes, thereby terminating the flushing action.

In normal flush the crank is rotated through an angle of about 45° which allows about 4 gallons of water to be flushed.

Although not shown, it should be recognized that the chamber of the present invention can have an open bottom configuration with the lower surface of the side walls being sealed to the toilet tank.

From the above, it can be seen that an improved apparatus for controlling the quantity of water through the outlet in a tank and hence the flushing of a toilet has been described which fulfills all of the objects and advantages set forth above.

Although the invention has been particularly shown and described with reference to a certain preferred embodiment, it will be understood by those skilled in the art that various alterations and modifications in form and detal may be made therein. Accordingly, it is intended that the following claims cover all such alterations and modifications as fall within the true spirit and scope of the invention.

What is claimed is:

1. In a toilet including a tank having a water outlet, an improved apparatus for controlling the quantity of water flowing through the outlet comprising:

a rotatable shaft having opposed first and second ends;

a crank connected to said first end and being capable of rotating said shaft through first and second angles when a force is applied to it;

means mounting said crank to the tank;

an arm connected to said second end;

means forming a chamber disposed in the tank and including first and second upwardly extending tubes forming first and second ports, respectively, and a third port arranged to discharge water through the water outlet, said first tube having an axial dimension that is greater than said second tube;

first valve means normally seated on said first port, said first valve means being movable from a normally closed position to an open position;

second valve means normally seated on said second port, said second valve means being movable from a normally closed position to an open position;

a pivot rod having first and second outer portions and an intermediate portion that is pivotally connected to said arm;

a first chain connected between said first outer portion and said first valve means and having a first length generally equal to the distance between such elements when said first valve means is in the closed position; and a second chain connected between said second outer portion and said second valve means and having a second length generally equal to the distance between such elements when said first valve means is in the open position, whereby when said crank is rotated toward said first angle, said arm is raised causing said rod to pivot toward said first valve means, and said first chain to become taut and unseat said first valve means such that when said crank reaches said first angle said first valve means is moved into said open position causing water to flow through said first port and out of said third port, said first valve means being closed by the suction action of the outflowing water when it reaches a level slightly above that corresponding to said first port, and whereby when said crank is rotated through an angle greater than said first angle, said second chain becomes taut, said rod pivots toward said second valve means and thereafter unseats said second valve means such that when said crank reaches said second angle said second valve means is moved into said open position causing water to flow through said first and second ports and out of said third port, said first port being closed when the water level falls to about that corresponding to said first port and said second port being closed when the water reaches a level slightly above that corresponding to said second port.

2. An improved apparatus as recited in claim 1 wherein the tank includes an opening in its front wall and said shaft is disposed through said opening.

3. An improved apparatus as recited in claim 2 wherein said means mounting said crank to the tank includes a mounting plate having a hole therethrough and a hollow mounting sleeve, said plate being mounted to the front wall such that said opening and said hole are aligned, said hollow sleeve extending through said hole and said opening and serving to rotatably carry said rotatable shaft.

4. An improved apparatus as recited in claim 1 wherein said means forming a chamber includes an upwardly extending element and said first and said second valve means are hingedly connected to said element.

5. An improved apparatus as recited in claim 4 wherein said element is disposed centrally between said first and second tubes.

6. An improved apparatus as recited in claim 5 wherein said element is generally parallel to said first and second tubes.

7. An improved apparatus as recited in claim 1 wherein said intermediate portion is pivotally connected proximate the distal end of said arm.

8. An improved apparatus as recited in claim 1 wherein said pivot rod has a generally arcuate shape.

9. An improved apparatus as recited in claim 1 wherein the distal end of said crank includes at least two fingers extending outwardly therefrom and further comprising a stop disposed adjacent the path of said fingers for stopping the rotation of said crank at an angle corresponding to each said finger whereby when the person flushing the toilet depresses one of said fingers, the crank is rotated until said finger is moved adjacent said stop which stops the angular rotation of said crank and limits the water flowing out of the tank to an amount corresponding to which of said fingers is depressed.

10. An improved apparatus as recited in claim 9 wherein said crank includes first and second fingers.

11. An improved apparatus as recited in claim 10 wherein said first finger is rotatable through an angle of about 22.5° and said second finger is rotatable through an angle of about 45°.

* * * * *